US010650769B2

(12) United States Patent
Zhang et al.

(10) Patent No.: US 10,650,769 B2
(45) Date of Patent: May 12, 2020

(54) DISPLAY SUBSTRATE, DRIVING METHOD THEREOF, DISPLAY PANEL

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Yuanbo Zhang, Beijing (CN); Wenhao You, Beijing (CN); Rui Xue, Beijing (CN); Rui Wang, Beijing (CN); Pengyue Zhang, Beijing (CN); Xiaolin Wang, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/241,689

(22) Filed: Jan. 7, 2019

(65) Prior Publication Data

US 2019/0237037 A1 Aug. 1, 2019

(30) Foreign Application Priority Data

Jan. 31, 2018 (CN) ..... 2018 1 0096976

(51) Int. Cl.
*G09G 3/36* (2006.01)

(52) U.S. Cl.
CPC ..... *G09G 3/3688* (2013.01); *G09G 3/3677* (2013.01); *G09G 2300/0408* (2013.01); *G09G 2310/08* (2013.01)

(58) Field of Classification Search
CPC .. G09G 3/3614; G09G 3/3659; G09G 3/3677; G09G 3/3688; G09G 2300/0408; G09G 2300/0426; G09G 2310/08
See application file for complete search history.

(56) References Cited

U.S. PATENT DOCUMENTS

2003/0090449 A1* 5/2003 Arimoto ..... G09G 3/3648 345/87
2004/0178981 A1* 9/2004 Asada ..... G09G 3/3614 345/96

(Continued)

FOREIGN PATENT DOCUMENTS

CN 101630100 A 1/2010
CN 102208172 A 10/2011

(Continued)

OTHER PUBLICATIONS

First Office Action and English language translation, CN Application No. 201810096976.1, dated Dec. 4, 2019, 20 pp.

*Primary Examiner* — Joe H Cheng
(74) *Attorney, Agent, or Firm* — Myers Bigel, P.A.

(57) ABSTRACT

The present disclosure provides a display substrate such that each pixel unit of the display substrate includes a switching circuit and a control circuit, and the switching circuit is connected to a corresponding gate line, a control circuit of a respective pixel unit, and a corresponding pixel electrode. The control circuit is configured to transmit a data signal on a corresponding data line to a switching circuit of the respective pixel unit under control of a corresponding control signal line, and n is an integer not less than 2. The present disclosure further provides a display device including the above display substrate and a driving method for the above display substrate.

20 Claims, 7 Drawing Sheets

(56) References Cited

U.S. PATENT DOCUMENTS

2005/0017934 A1* 1/2005 Chung ..... G09G 3/3233 345/82
2006/0001628 A1* 1/2006 Kawaguchi ..... G09G 3/3648 345/89
2006/0022929 A1* 2/2006 Hashimoto ..... G09G 3/2011 345/96
2006/0028463 A1* 2/2006 Nakamura ..... G09G 3/3677 345/204
2006/0061540 A1* 3/2006 Harada ..... G09G 3/3677 345/103
2006/0114220 A1* 6/2006 Wang ..... G09G 3/3614 345/103
2006/0151745 A1* 7/2006 Kim ..... G09G 3/325 252/301.16
2006/0290644 A1* 12/2006 Kim ..... G09G 3/3677 345/100
2008/0150846 A1* 6/2008 Chung ..... G09G 3/3233 345/80
2009/0185082 A1* 7/2009 Hashimoto ..... G09G 3/3614 348/739
2009/0225066 A1* 9/2009 Sawahata ..... G09G 3/3677 345/211
2010/0013803 A1 1/2010 Noguchi et al.
2010/0182297 A1* 7/2010 Lan ..... G09G 3/3614 345/211
2011/0234653 A1 9/2011 Ueda
2012/0105421 A1* 5/2012 Tsai ..... G09G 3/3233 345/212
2012/0139905 A1* 6/2012 Hwang ..... H04N 13/398 345/419
2012/0147060 A1* 6/2012 Jeong ..... G09G 3/3233 345/690
2012/0293479 A1* 11/2012 Han ..... G09G 3/003 345/212
2015/0049126 A1* 2/2015 Jung ..... G09G 3/3233 345/690
2015/0187270 A1* 7/2015 Lee ..... G09G 3/3233 345/76
2015/0221270 A1* 8/2015 Lee ..... G09G 3/3614 345/209
2015/0302793 A1* 10/2015 In ..... G09G 3/3208 345/211
2016/0005346 A1* 1/2016 Kim ..... G09G 3/3266 345/690
2016/0086978 A1 3/2016 French et al.
2016/0180785 A1 6/2016 Jin et al.
2018/0024675 A1* 1/2018 Hong ..... H01L 27/3218 345/174

FOREIGN PATENT DOCUMENTS

CN 104714319 A 6/2015
CN 106157903 A 11/2016
CN 106842748 A 6/2017

* cited by examiner

DISPLAY SUBSTRATE, DRIVING METHOD THEREOF, DISPLAY PANEL

CROSS REFERENCE TO RELATED APPLICATIONS

This U.S. non-provisional patent application claims priority under 35 U.S.C. § 119 to Chinese patent application No. 201810096976.1 filed on Jan. 31, 2018, the entire disclosure of which is incorporated herein by reference.

FIELD

The present disclosure generally relates to the field of display. More specifically, the present disclosure relates to a display substrate, a display panel comprising the display substrate, and a method for driving the display substrate.

BACKGROUND

Among currently rapidly developing liquid crystal display technologies, thin film transistor (TFT) liquid crystal displays (LCDs) have been widely favored due to their advantages such as large capacity, high definition, high quality true full color, and the like. An important performance indicator for a TFT-LCD is resolution. The resolution of a TFT-LCD indicates the number of light-emitting points that can be used as image display in an effective display area, wherein the light-emitting points are referred to as pixels. The resolution reflects the total number of pixels in the effective display area. The higher the resolution is, the greater the image resolution will be.

Generally, human eyes are more sensitive to the number of pixels in a vertical direction. The higher the resolution in the vertical direction is, the higher definition images will have. However, the higher resolution in the vertical direction means that a larger number of gate lines need to be used for driving rows of pixels. For a scheme of driving gate lines using a gate driving integrated circuit, the number of driving channels of the gate driving integrated circuit increases as the number of gate lines increases, so that the gate driving integrated circuit is more expensive. Moreover, the larger the area occupied by fanout lines is, the larger a bezel of a TFT-LCD will be. For a scheme of driving gate lines using a GOA circuit, the number of required GOA units increases as the number of gate lines increases, so that power consumption of the GOA circuit is greater and the bezel of a TFT-LCD is larger.

In view of the above, there is a need in the art for an improved display substrate, a driving method thereof, and a display panel.

SUMMARY

It is an object of the present disclosure to provide a display substrate, a driving method thereof, and a display panel, which are capable of at least partially alleviating or eliminating one or more of the above-mentioned problems in the prior art.

According to an aspect of the present disclosure, there is provided a display substrate comprising a plurality of pixel units arranged in a matrix. The plurality of pixel units are divided into multiple groups of pixel units along a column direction of the pixel units, each group of pixel units including n rows of pixel units. The display substrate further comprises a plurality of gate lines extending along a row direction of the pixel units, the plurality of gate lines being in one-to-one correspondence with the multiple groups of pixel units; a plurality of data lines extending along the column direction of the pixel units, the plurality of data lines being in one-to-one correspondence with pixel unit columns in the matrix; and n control signal lines extending along the row direction of the pixel units, the n control signal lines being in one-to-one correspondence with n rows of pixel units in each group of pixel units. Each pixel unit comprises a switching circuit and a control circuit. The switching circuit is connected to a corresponding gate line, a control circuit of a pixel unit where the switching circuit resides, and a corresponding pixel electrode. The control circuit is configured to transmit a data signal on a corresponding data line to a switching circuit of a pixel unit where the control circuit resides under the control of a corresponding control signal line. n is an integer not less than 2.

According to some embodiments of the present disclosure, the switching circuit comprises a switching transistor, a control terminal of the switching transistor being connected to a corresponding gate line, a first terminal of the switching transistor being connected to a control circuit of a pixel unit where the switching transistor resides, and a second terminal of the switching transistor being connected to a corresponding pixel electrode.

According to some embodiments of the present disclosure, the n control signal lines are in one-to-one correspondence with n rows of pixel units in each group of pixel units in forward order. That is, in such embodiments, in each group of pixel units, along the column direction of the pixel units, a first row of pixel units are connected to a first control signal line, a second row of pixel units are connected to a second control signal line, . . . , a (n−1)-th row of pixel units are connected to a (n−1)-th control signal line, and an n-th row of pixel units are connected to an n-th control signal line.

According to some embodiments of the present disclosure, the n control signal lines are in one-to-one correspondence with n rows of pixels units in odd-numbered groups of pixel units in forward order, and the n control signal lines are in one-to-one correspondence with n rows of pixel units in even-numbered groups of pixel units in reverse order. That is, in such embodiments, in each odd-numbered group of pixel units, along the column direction of the pixel units, the first row of pixel units are connected to the first control signal line, the second row of pixel units are connected to the second control signal line, . . . , the (n−1)-th row of pixel units are connected to the (n−1)-th control signal line, and the n-th row of pixel units are connected to the n-th control signal line. In each even-numbered group of pixel units, along the column direction of the pixel units, the first row of pixel units are connected to the n-th control signal line, the second row of pixel units are connected to the (n−1)-th control signal line, . . . , the (n−1)-th row of pixel units are connected to the second control signal line, and the n-th row of pixel units are connected to the first control signal line.

Further, in the above embodiments, optionally, along the column direction of the pixel units, the first row of pixel units in each even-numbered group of pixel units and the last row of pixel units in a previous group of pixel units are connected to the n-th control signal line through the same connection line. That is, for the first row of pixel units in each even-numbered group of pixel units and the last row of pixel units in the previous group of pixel units, since they are connected to the same control signal line, a connection line may be shared to connect to the same control signal line, which further reduces the number and complexity of wirings in the display substrate.

According to some embodiments of the present disclosure, the control circuit comprises a control transistor. A control terminal of the control transistor is connected to a corresponding control signal line, a first terminal of the control transistor is connected to a corresponding data line, and a second terminal of the control transistor is connected to a first terminal of a switching transistor of a pixel unit where the control transistor resides. In such embodiments, the control transistor is connected in series with the switching transistor and is configured to transmit a data signal on a data line to which its first terminal is connected to the first terminal of a switching transistor to which its second terminal is connected under the control of the control signal line to which its control terminal is connected.

According to some embodiments of the present disclosure, n is equal to 2. In such embodiments, compared to the prior art solution in which each row of pixel units are connected to one gate line, if the same resolution in the vertical direction is achieved, the number of gate lines is halved, which contributes to reducing the cost and power consumption of the display substrate, and helps to reduce the size of the bezel of the display substrate and increase the proportion of the effective display area. If the same number of gate lines are used, the resolution in the vertical direction is doubled, which improves the display effect and enhances the market competitiveness of the product.

According to some embodiments of the present disclosure, the plurality of gate lines are connected to a gate driving integrated circuit. That is, in such embodiments, the plurality of gate lines are driven by an external gate driving integrated circuit.

According to some embodiments of the present disclosure, the plurality of gate lines are connected to a GOA circuit. That is, in such embodiments, the gate driving circuit is directly fabricated on an array substrate, and the plurality of gate lines are driven by the GOA circuit.

According to another aspect of the present disclosure, there is provided a display panel comprising any of the display substrates described above.

According to some embodiments of the present disclosure, the display panel is a liquid crystal display panel.

According to some embodiments of the present disclosure, the liquid crystal display panel is fabricated based on a low-temperature polysilicon process. When a-Si is used to fabricate a TFT switch, since the electron mobility of a-Si is less than 1 $cm^2/V \cdot s$, the development of a TFT-LCD to a more precise, thinner and more power-saving direction is restricted. In contrast, by using a low-temperature polysilicon LTPS technology with a process temperature lower than 600° C., the electron mobility of the TFT can reach 300 $cm^2/V \cdot s$, which makes it possible to integrate a circuit system on glass while improving the pixel writing capability.

According to a further aspect of the present disclosure, there is provided a driving method for any of the display substrates described above. The driving method comprises dividing each frame display time into n display time periods, and applying an active level to the n control signal lines in the n display time periods, respectively. In each display time period, an active level is applied to the plurality of gate lines successively, and a data signal having an opposite polarity to that in a previous display time period is applied to the plurality of data lines, respectively, wherein a polarity of a data signal applied to each data line is opposite to that of a data signal applied to a data line adjacent to said data line, and the polarity of the data signal applied to each data line is inverted between adjacent frames.

In the above driving method, when a refresh of one frame image ends, pixel voltages of adjacent pixel units are kept opposite in polarity, so that flickers of the display substrate can be effectively suppressed.

In addition, the above display panel and driving method have embodiments and advantages corresponding to or similar to the display substrate described above, which are not described herein again.

It is to be understood that the above general description and the following detailed description are merely exemplary and illustrative, which are not intended to limit the present disclosure in any way.

BRIEF DESCRIPTION OF THE DRAWINGS

These and other aspects of the present disclosure will now be described in more detail with reference to the accompanying drawings that illustrate embodiments of the present disclosure, wherein the figures are not necessarily drawn to scale and put an emphasis on illustrating the principle of the present disclosure. In the drawings, FIG. 1 schematically illustrates a top view of a display substrate according to an embodiment of the present disclosure.

The same reference numerals are used to demote the same parts throughout the drawings.

Embodiments of the present disclosure have been illustrated by the above-described figures, which will be described in more detail later. These figures and literal description are not intended to limit the scope of the present disclosure in any way, but to illustrate the concept of the present disclosure for those ordinarily skilled in the art with reference to specific embodiments.

DETAILED DESCRIPTION

The present disclosure will now be described more comprehensively below with reference to the accompanying drawings, in which embodiments of the present disclosure are illustrated. The present disclosure, however, may be embodied in a number of different forms and should not be construed as being limited to embodiments set forth herein. Rather, these embodiments are provided for the sake of completeness and thoroughness and to fully convey the scope of the present disclosure to the skilled person.

Figure 1:
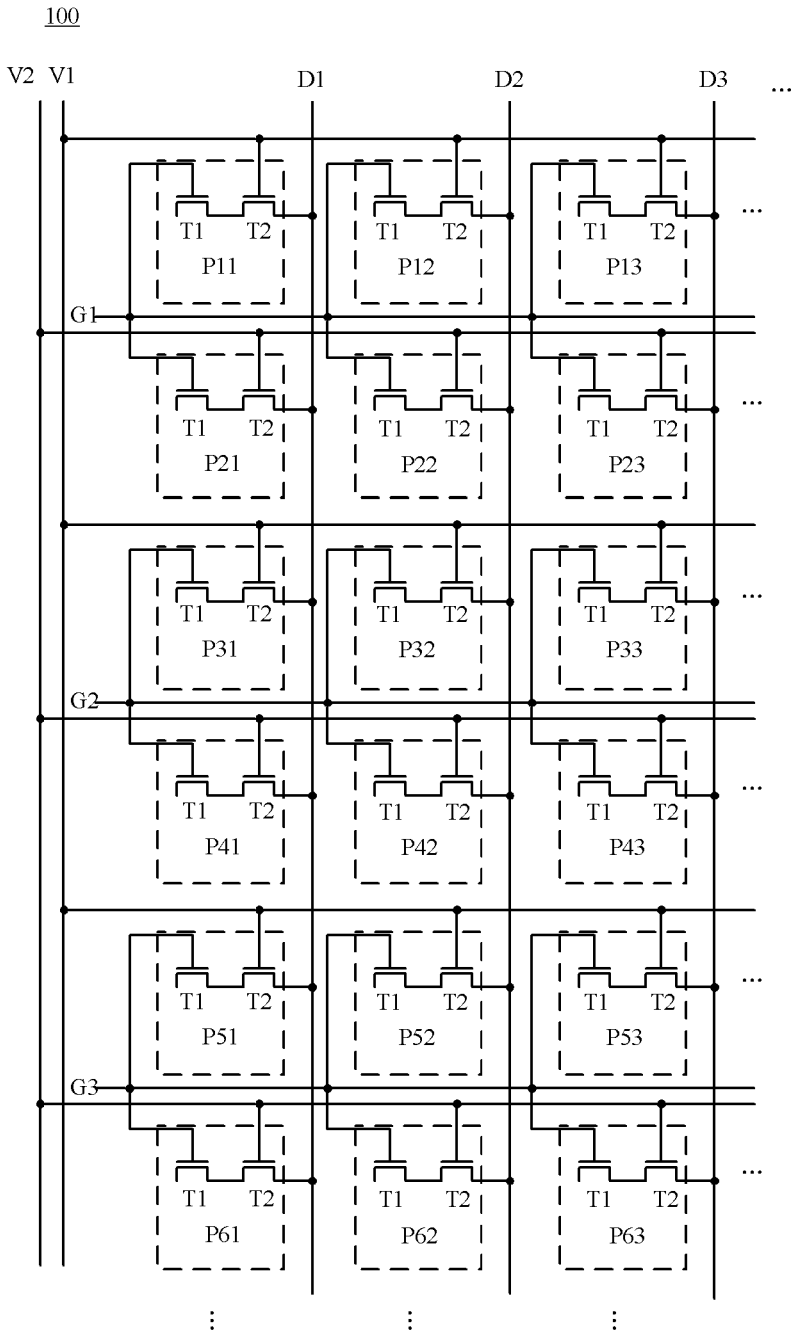

FIG. 1 illustrates a top view of a display substrate according to an embodiment of the present disclosure. As shown in FIG. 1, a display substrate 100 comprises a plurality of pixel units P1, P2, P3, P4 . . . arranged in a matrix. The plurality of pixel units are divided into multiple groups of pixel units along a column direction of the pixel units, each group of pixel units including two rows of pixel units. The display substrate 100 comprises a plurality of gate lines G1, G2, G3 . . . extending in a row direction of the pixel units, wherein a first gate line G1 is connected to a first group of pixel units, a second gate line G2 is connected to a second group of pixel units, a third gate line G3 is connected to a third group of pixel units, and so on. The display substrate 100 comprises a plurality of data lines D1, D2, D3 . . . extending in the column direction of the pixel units, wherein a first data line D1 is connected to a first column of pixel units, a second data line D2 is connected to a second column of pixel units, a third data line D3 is connected to a third column of pixel units, and so on. The display substrate 100 further comprises two control signal lines V1, V2 extending in the row direction of the pixel units, wherein a first control signal line V1 is connected to a first row of pixel units in each group of pixel units, and a second control signal line V2 is connected to a second row of pixel units in each group of pixel units. Each of the pixel units comprises a switching circuit T1 and a control circuit T2. The switching circuit T1 is connected to a corresponding gate line G1, G2, G3 . . . , the control circuit T2 of a pixel unit where the switching circuit resides, and a corresponding pixel electrode (not shown). The control circuit T2 is configured to transmit a data signal on a corresponding data line D1, D2, D3 . . . to the switching circuit of a pixel unit where the control circuit T2 resides under the control of a corresponding control signal line V1, V2.

In the display substrate as shown in FIG. 1, the plurality of pixel units are divided into multiple groups of pixel units along a column direction of the pixel units, each group of pixel units includes two rows of pixel units, and each group of pixel units share one gate line. Therefore, compared to the prior art solution in which each row of pixel units are connected to one gate line, if the same resolution in the vertical direction is achieved, the number of gate lines is halved, which contributes to reducing the cost and power consumption of the display substrate, and helps to reduce the size of the bezel of the display substrate and increase the proportion of the effective display area. If the same number of gate lines are used, the resolution in the vertical direction is doubled, which improves the display effect and enhances the market competitiveness of the product.

Figure 2:
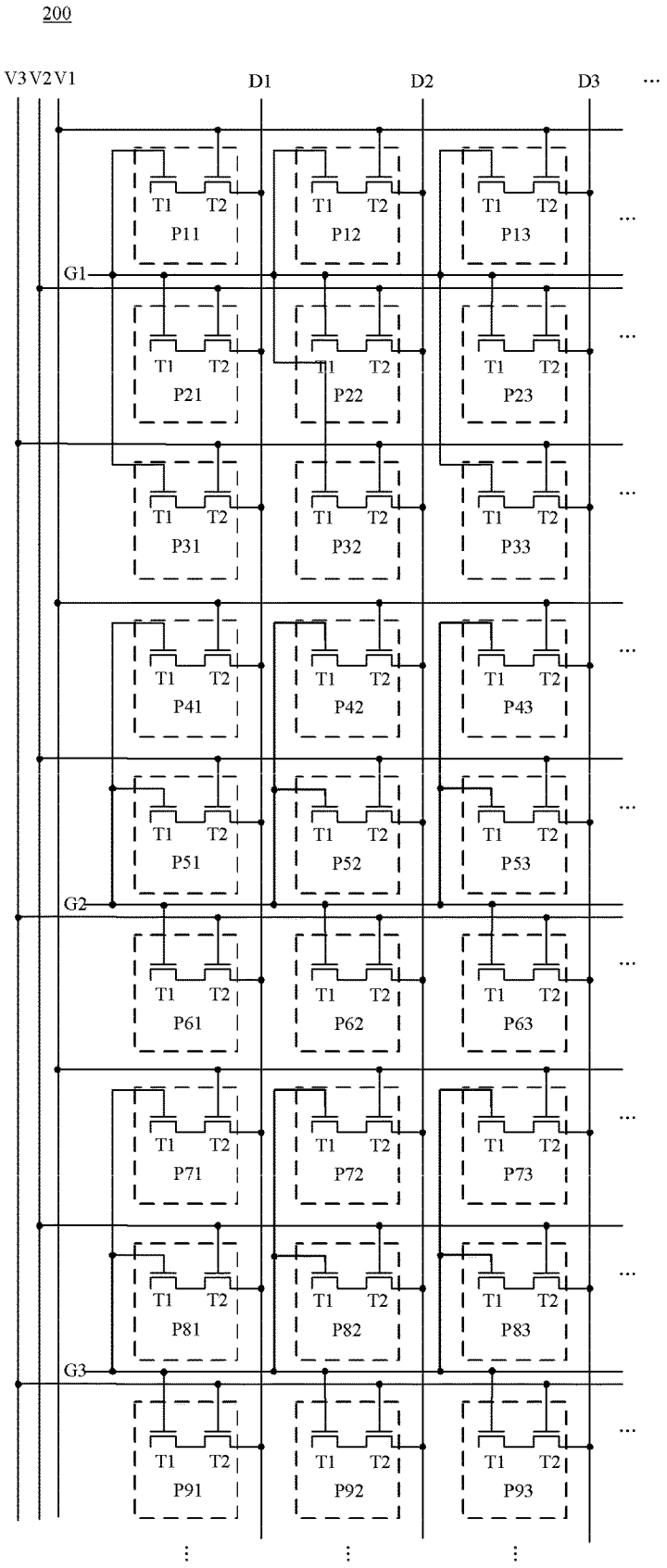
FIG. 2 schematically illustrates a top view of a display substrate according to another embodiment of the present disclosure.

It is to be noted that the concept of the present disclosure is not limited to each group of pixel units including two rows of pixel units. In other embodiments of the present disclosure, each group of pixel units may include three rows or even more rows of pixel units. For example, as shown in FIG. 2, each group of pixel units includes three rows of pixel units. In this case, a display substrate 200 comprises three control signal lines V1, V2, V3 extending in the row direction of the pixel units, wherein a first control signal line V1 is connected to a first row of pixel units in each group of pixel units, a second control signal line V2 is connected to a second row of pixel units in each group of pixel units, and a third control signal line V3 is connected to a third row of pixel units in each group of pixel units. Similarly to FIG. 1, in the display substrate 200, each pixel unit comprises a switching circuit T1 and a control circuit T2. The switching circuit T1 is connected to a corresponding gate line G1, G2, G3 . . . , the control circuit T2 of a pixel unit where the switching circuit resides, and a corresponding pixel electrode (not shown). The control circuit T2 is configured to transmit a data signal on a corresponding data line D1, D2, D3 . . . to the switching circuit of a pixel unit where the control circuit T2 resides under the control of a corresponding control signal line V1, V2, V3.

Therefore, generally, in the display substrate provided by the present disclosure, each group of pixel units includes n rows of pixel units, and the display substrate comprises n control signal lines extending in the row direction of the pixel units. The n control signal lines are in one-to-one correspondence with n rows of pixel units in each group of pixel units. Specifically, n is an integer not less than 2.

In the above display substrate according to the present disclosure, the plurality of pixel units are divided into multiple groups of pixel units along a column direction of the pixel units, each group of pixel units includes n rows of pixel units, and each group of pixel units shares one gate line. Therefore, compared to the prior art solution in which each row of pixel units are connected to one gate line, if the same resolution in the vertical direction is achieved, the number of gate lines is greatly reduced, which contributes to reducing the cost and power consumption of the display substrate, and helps to reduce the size of the bezel of the display substrate and increase the proportion of the effective display area. If the same number of gate lines are used, the resolution in the vertical direction is greatly increased, which improves the display effect and enhances the market competitiveness of the product.

Further, as shown in FIGS. 1 and 2, the n control signal lines are in one-to-one correspondence with n rows of pixel units in each group of pixel units in forward order. That is, in such an embodiment, in each group of pixel units, along the column direction of the pixel units, the first row of pixel units are connected to the first control signal line V1, the second row of pixel units are connected to the second control signal line V2, . . . , an (n−1)-th row of pixel units are connected to an (n−1)-th control signal line, and an n-th row of pixel units are connected to an n-th control signal line.

Figure 3:
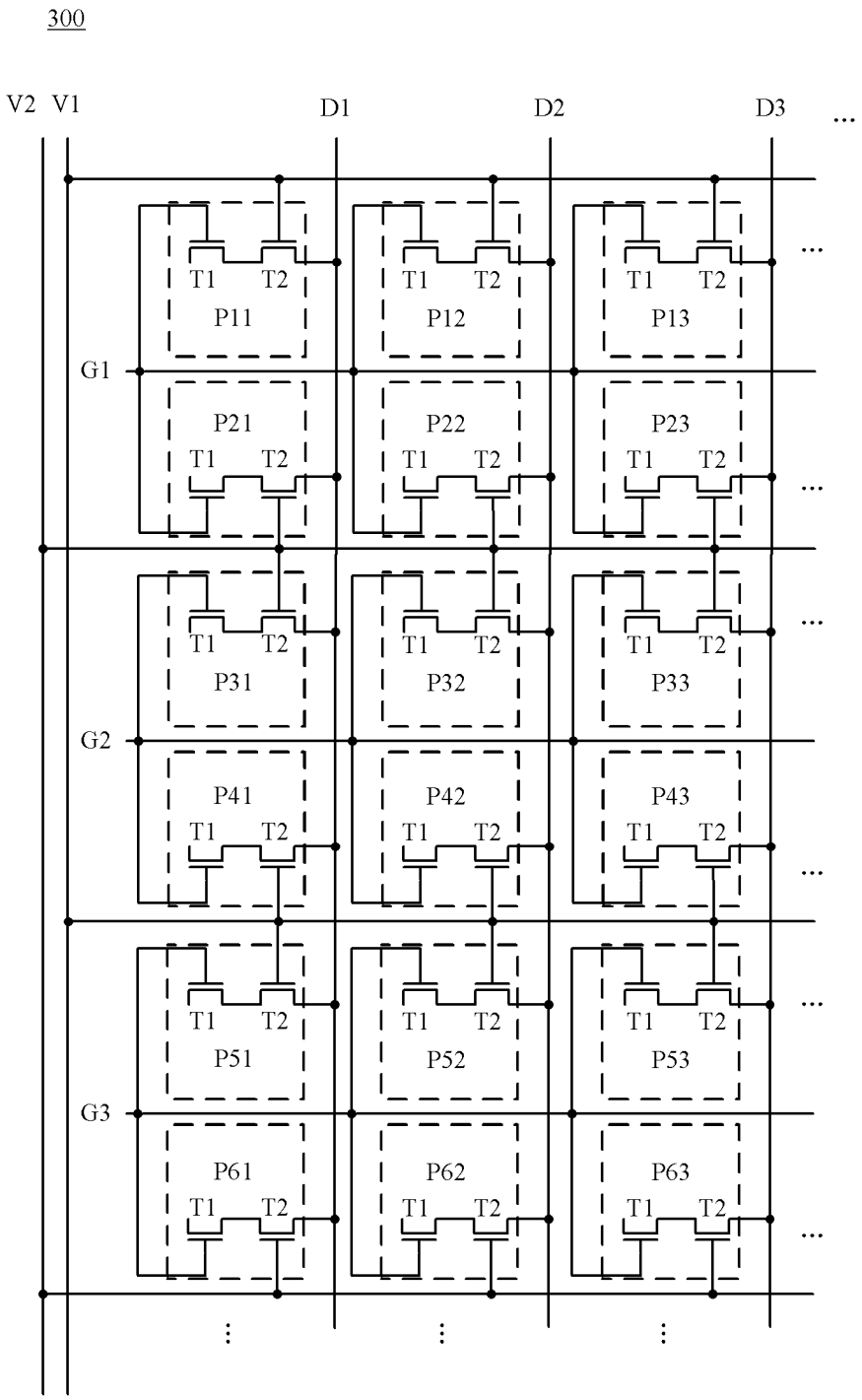
FIG. 3 schematically illustrates a top view of a display substrate according to a further embodiment of the present disclosure.

Alternatively, the n control signal lines are in one-to-one correspondence with n rows of pixel units in odd-numbered groups of pixel units in forward order, and the n control signal lines are in one-to-one correspondence with n rows of pixel units in even-numbered groups of pixel units in reverse order. For example, as shown in FIG. 3, taking n=2 as an example, in each odd-numbered group of pixel units, along the column direction of the pixel units, the first row of pixel units are connected to the first control signal line V1, and the second row of pixel units are connected to the second control signal line V2. In each even-numbered group of pixel units, along the column direction of the pixel units, the first row of pixel units are connected to the second control signal line V2, and the second row of pixel units are connected to the first control signal line V1.

Optionally, in the above-described embodiment, along the column direction of the pixel units, the first row of pixel units in each group of pixel units and the last row of pixel units in a previous group of pixel units are connected to a corresponding control signal line through a same connection line. For example, as shown in FIG. 3, along the column direction of the pixel units, the first row of pixel units in the second group of pixel units and the last row of pixel units in the first group of pixel units are connected to the second control signal line V2 by sharing one connection line, and the first row of pixel units in the third group of pixel units and the last row of pixel units in the second group of pixel units are connected to the first control signal line V1 by sharing one connection line, thereby further reducing the number and complexity of wirings in the display substrate.

In an exemplary embodiment, as shown in FIGS. 1-3, the switching circuit T1 may comprises a switching transistor. A control terminal of the switching transistor is connected to a corresponding gate line G1, G2, G3 . . . , a first terminal of the switching transistor is connected to the control circuit T2 of a pixel unit where the switching transistor resides, and a second terminal of the switching transistor is connected to a corresponding pixel electrode. Optionally, the control circuit T2 may comprise a control transistor. A control terminal of the control transistor is connected to a corresponding control signal line V1, V2, V3 . . . , a first terminal of the control transistor is connected to a corresponding data line D1, D2, D3, . . . , and a second terminal of the control transistor is connected to the first terminal of the switching transistor T1 of a pixel unit where the control transistor resides. In such an embodiment, the control transistor is connected in series with the switching transistor and is configured to transmit a data signal on the data line to which its first terminal is connected to the first terminal of the switching transistor to which its second terminal is connected under the control of the control signal line to which its control terminal is connected.

Although an embodiment of the control circuit is illustrated in FIGS. 1-3 taking a control transistor as an example, the present disclosure is not so limited. As will be appreciated by those skilled in the art, the control circuit can employ any circuit having a gating function, such as a multiplexer or the like.

In an embodiment of the present disclosure, the gate lines may be connected to an external gate driving integrated circuit. In such an embodiment, the bezel of the display substrate is determined by the sum of the width of the gate driving integrated circuit, the width of the drive channels, and the width of the fanout line. By reducing the number of gate lines, the number of drive channels of the gate driving integrated circuit is reduced, so that the price of the gate driving integrated circuit is lowered, and the bezel of the display substrate is reduced.

Alternatively, in other embodiments of the present disclosure, the gate lines may be connected to a GOA circuit. In such an embodiment, the bezel of the display substrate is determined by the width of the GOA circuit. By reducing the number of gate lines, the number of required GOA units is reduced, so that the power consumption of the GOA circuit is decreased, and the bezel of the display substrate is reduced.

According to another aspect of the present disclosure, there is provided a display panel comprising any of the display substrates described above. The display panel itself may be a final display product or may be packaged with a suitable housing to provide a final display product.

In such a display panel, the plurality of pixel units are divided into multiple groups of pixel units along a column direction of the pixel units, each group of pixel units includes n rows of pixel units, and each group of pixel units shares one gate line. Therefore, compared to the prior art solution in which each row of pixel units are connected to one gate line, if the same resolution in the vertical direction is achieved, the number of gate lines is greatly reduced, which contributes to reducing the cost and power consumption of the display panel, and helps to reduce the size of the bezel of the display panel and increase the proportion of the effective display area. If the same number of gate lines are used, the resolution in the vertical direction is greatly increased, which improves the display effect and enhances the market competitiveness of the product.

Specifically, in an exemplary embodiment, the display panel is a liquid crystal display panel.

In an exemplary embodiment, the above liquid crystal display panel may be fabricated based on a low-temperature polysilicon process. When a-Si is used to fabricate a TFT switch, since the electron mobility of a-Si is less than 1 $cm^2/V\cdot s$, the development of a TFT-LCD to a more precise, thinner, and more power-saving direction is restricted. In contrast, by using a low-temperature polysilicon LTPS technology with a process temperature lower than 600° C., the electron mobility of the TFT can reach 300 $cm^2/V\cdot s$, which makes it possible to integrate a circuit system on glass while improving the pixel writing capability.

A further aspect of the present disclosure provides a driving method for any of the display substrates described above. In the driving method, each frame display time is divided into n display time periods, and an active level is applied to the n control signal lines in the n display time periods, respectively. An active level is applied to the plurality of gate lines successively in each display time period, and a data signal having an opposite polarity to that in a previous display time period is applied to the plurality of data lines, respectively, wherein the polarity of the data signal applied to each data line is opposite to that of the data signal applied to a data line adjacent to the data line, and the polarity of the data signal applied to each data line is inverted between adjacent frames.

As used herein, the term "active level" is a level which makes a respective transistor turned on. Specifically, if the switching transistor and the control transistor are P-type transistors, the active level of the gate line and the control signal line is a low level. If the switching transistor and the control transistor are N-type transistors, the active level of the gate line and the control signal line are a high level.

In the above driving method, when the refresh of one frame image ends, the pixel voltages of adjacent pixel units are kept opposite in polarity, so that flickers of the display substrate can be effectively suppressed.

Figure 4:
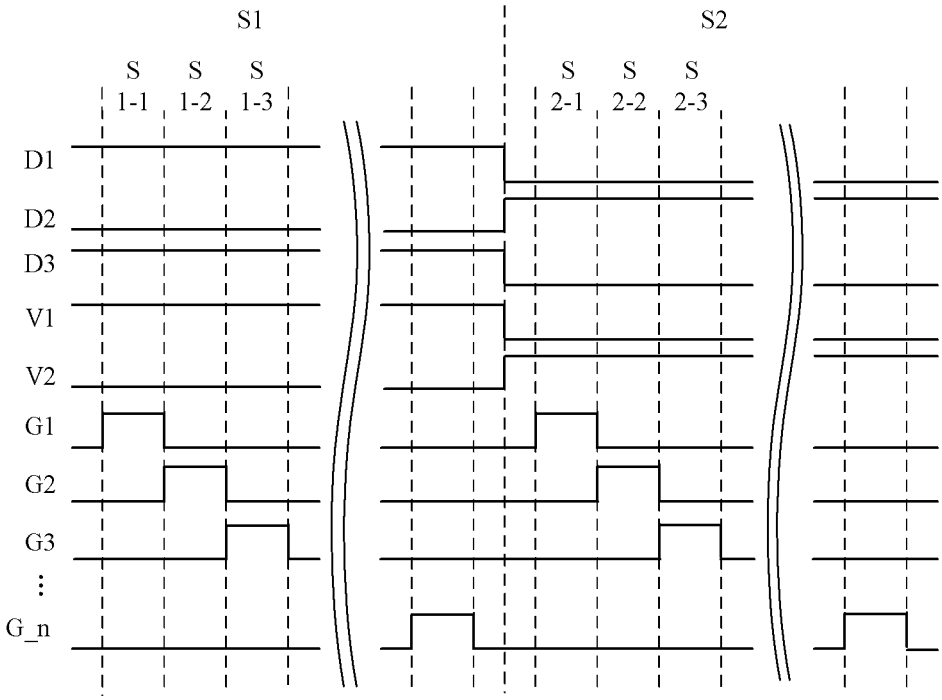
FIG. 4 schematically illustrates a timing chart of a driving method for the display substrate as shown in FIG. 1.

Specifically, FIG. 4 schematically illustrates a timing chart of a driving method for the display substrate as shown in FIG. 1. Hereinafter, description will be made based on an example in which the switching transistor T1 and the control transistor T2 are N-type transistors. However, as will be appreciated by those skilled in the art, this driving method is similarly applicable to P-type transistors.

As shown in FIG. 4, each frame display time is divided into two display time periods S1 and S2. A high level is applied to the two control signal lines V1 and V2 in a first display time period S1 and a second display time period S2, respectively. In each display time period S1 or S2, a high level is applied to the plurality of gate lines G1, G2, G3, . . . , G_n successively. In the second display time period S2, a data signal having an opposite polarity to that in the first display time period S1 is applied to the plurality of data lines D1, D2, D3 . . . , respectively. In each frame, the polarity of the data signal applied to each of the data lines D1, D2, D3 . . . is always opposite to the polarity of the data signal applied to a data line adjacent thereto, and the polarity of the data signal applied to each of the data lines D1, D2, D3 . . . is inverted between adjacent frames FN and F(N+1).

Taking the frame FN as an example, in the first display time period S1, a high level is applied to the first control signal line V1, so that the control transistors T2 of the first row of pixel units, the third row of pixel units, and the fifth row of pixel units are turned on. A low level is applied to the second control signal line V2, so that the control transistors T2 of the second row of pixel units, the fourth row of pixel units, and the sixth row of pixel units are turned off. A positive polarity data signal is applied to the first data line D1, a negative polarity data signal is applied to the second data line D2, a positive polarity data signal is applied to the third data line D3, and so on. In a first sub-display time period S1-1, a high level is applied to the first gate line G1, so that the switching transistors T1 of the first group of pixel units are turned on; in a second sub-display time period S1-2, a high level is applied to the second gate line G2, so that the switching transistors T1 of the second group of pixel units are turned on; in a third sub-display time period S1-3, a high level is applied to the third gate line G3, so that the switching transistors T1 of the third group of pixel units are turned on; and so on. As a result, in the first sub-display time period S1-1, the first data line D1 applies a positive polarity data signal to a pixel electrode through a control transistor T2 and a switching transistor T1 of a pixel unit P11, the second data line D2 applies a negative polarity data signal to a pixel electrode through a control transistor T2 and a switching transistor T1 of a pixel unit P12, the third data line D3 applies a positive polarity data signal to a pixel electrode through a control transistor T2 and a switching transistor T1 of a pixel unit P13, and so on. In the second sub-display time period S1-2, the first data line D1 applies a positive polarity data signal to a pixel electrode through a control transistor T2 and a switching transistor T1 of a pixel unit P31, the second data line D2 applies a negative polarity data signal to a pixel electrode through a control transistor T2 and a switching transistor T1 of a pixel unit P32, the third data line D3 applies a positive polarity data signal to a pixel electrode through a control transistor T2 and a switching transistor T1 of a pixel unit P33, and so on. In the third sub-display time period S1-3, the first data line D1 applies a positive polarity data signal to a pixel electrode through a control transistor T2 and a switching transistor T1 of a pixel unit P51, the second data line D2 applies a negative polarity data signal to a pixel electrode through a control transistor T2 and a switching transistor T1 of a pixel unit P52, the third data line D3 applies a positive polarity data signal to a pixel electrode through a control transistor T2 and a switching transistor T1 of a pixel unit P53, and so on.

In the second display time period S2, a low level is applied to the first control signal line V1, so that the control transistors T2 of the first row of pixel units, the third row of pixel units, and the fifth row of pixel units are turned off. A high level is applied to the second control signal line V2, so that the control transistors T2 of the second row of pixel units, the fourth row of pixel units, and the sixth row of pixel units are turned on. A negative polarity data signal is applied to the first data line D1, a positive polarity data signal is applied to the second data line D2, a negative polarity data signal is applied to the third data line D3, and so on. In a first sub-display time period S2-1, a high level is applied to the first gate line G1, so that the switching transistors T1 of the first group of pixel units are turned on; in a second sub-display time period S2-2, a high level is applied to the second gate line G2, so that the switching transistors T1 of the second group of pixel units are turned on; in a third sub-display time period S2-3, a high level is applied to the third gate line G3, so that the switching transistors T1 of the third group of pixel units are turned on; and so on. As a result, in the first sub-display time period S2-1, the first data line D1 applies a negative polarity data signal to a pixel electrode through a control transistor T2 and a switching transistor T1 of a pixel unit P21, the second data line D2 applies a positive polarity data signal to a pixel electrode through a control transistor T2 and a switching transistor T1 of a pixel unit P22, the third data line D3 applies a negative polarity data signal to a pixel electrode through a control transistor T2 and a switching transistor T1 of a pixel unit P23, and so on. In the second sub-display time period S2-2, the first data line D1 applies a negative polarity data signal to a pixel electrode through a control transistor T2 and a switching transistor T1 of a pixel unit P41, the second data line D2 applies a positive polarity data signal to a pixel electrode through a control transistor T2 and a switching transistor T1 of a pixel unit P42, the third data line D3 applies a negative polarity data signal to a pixel electrode through a control transistor T2 and a switching transistor T1 of a pixel unit P43, and so on. In the third sub-display time period S2-3, the first data line D1 applies a negative polarity data signal to a pixel electrode through a control transistor T2 and a switching transistor T1 of a pixel unit P61, the second data line D2 applies a positive polarity data signal to a pixel electrode through a control transistor T2 and a switching transistor T1 of a pixel unit P62, the third data line D3 applies a negative polarity data signal to a pixel electrode through a control transistor T2 and a switching transistor T1 of a pixel unit P63, and so on.

Figure 5:
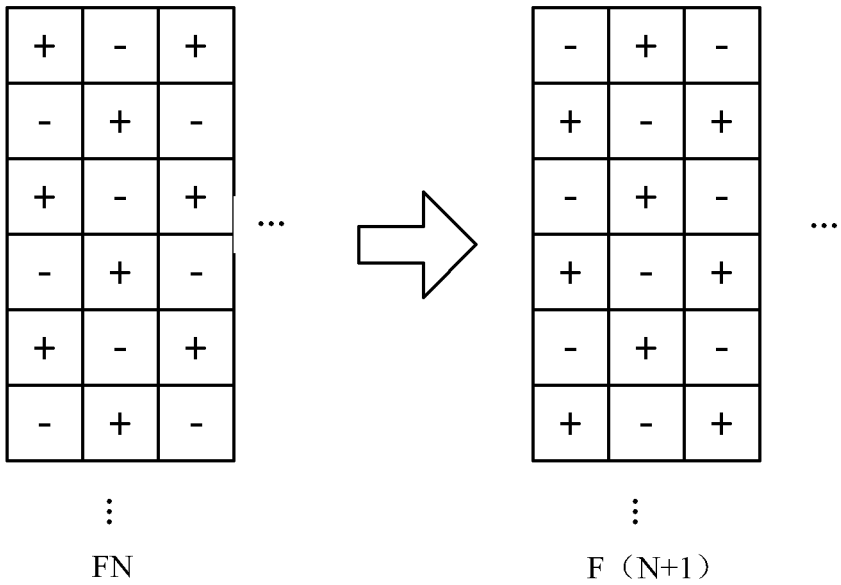
FIG. 5 schematically illustrates a pixel voltage polarity diagram for the driving method as shown in FIG. 4.

FIG. 5 schematically illustrates a pixel voltage polarity diagram for the driving method as shown in FIG. 4 when the refresh of one frame image ends. As shown in FIG. 5, in an N-th frame FN, the polarity of the pixel voltage is inverted once per row in the column direction, and the polarities of adjacent pixel voltages in the row direction are opposite to each other. Further, in the (N+1)-th frame F(N+1), the polarity of the pixel voltage of each pixel unit is opposite to that in the previous frame FN.

As can be seen from FIG. 5, the driving method shown in FIG. 4 employs dot inversion, that is, in the same frame image, each pixel unit maintains an opposite polarity with respect to the upper, lower, left, and right pixel units adjacent to itself, and in the next frame image, the polarities of the pixel voltages of all the pixel units are inverted simultaneously. By such processing, flicker suppression is refined to each pixel unit, so that an optimum flicker suppression effect is achieved. However, since dot inversion is high frequency inversion, power consumption is great.

Figure 6:
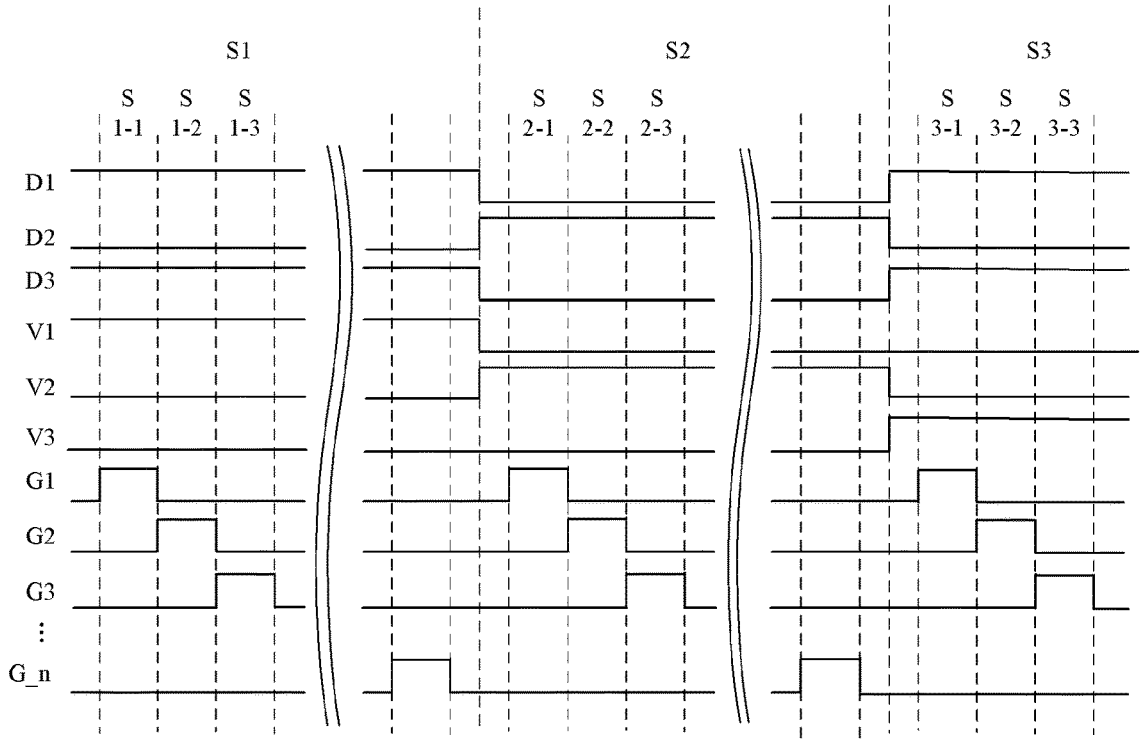
FIG. 6 schematically illustrates a timing chart of a driving method for the display substrate as shown in FIG. 2.

FIG. 6 schematically illustrates a timing chart of a driving method for the display substrate as shown in FIG. 2. Hereinafter, description will be made based on an example in which the switching transistor T1 and the control transistor T2 are N-type transistors. However, as will be appreciated by those skilled in the art, this driving method is similarly applicable to P-type transistors.

As shown in FIG. 6, each-frame display time is divided into three display time periods S1, S2, S3. A high level is applied to the three control signal lines V1, V2 and V3 in a first display time period S1, a second display time period S2, and a third display time S3, respectively. In each display time period S1 or S2 or S3, a high level is applied to the plurality of gate lines G1, G2, G3, . . . , G_n successively. In the second display time period S2, a data signal having an opposite polarity to that in the first display time period S1 and the third display time period S3 is applied to the plurality of data lines D1, D2, D3 . . . , respectively. In each frame, the polarity of the data signal applied to each of the data lines D1, D2, D3 . . . is always opposite to the polarity of the data signal applied to a data line adjacent thereto, and the polarity of the data signal applied to each of the data lines D1, D2, D3 . . . is inverted between adjacent frames FN and F(N+1).

Taking the frame FN as an example, in the first display time period S1, a high level is applied to the first control signal line V1, so that the control transistors T2 of the first row of pixel units, the fourth row of pixel units, and the seventh row of pixel units are turned on. A low level is applied to the second control signal line V2 and the third control signal line V3, so that the control transistors T2 of the second row of pixel units, the third row of pixel units, the fifth row of pixel units, the sixth row of pixel units, the eighth row of pixel units, and the ninth row of pixel units are turned off. A positive polarity data signal is applied to the first data line D1, a negative polarity data signal is applied to the second data line D2, a positive polarity data signal is applied to the third data line D3, and so on. In a first sub-display time period S1-1, a high level is applied to the first gate line G1, so that the switching transistors T1 of the first group of pixel units are turned on; in a second sub-display time period S1-2, a high level is applied to the second gate line G2, so that the switching transistors T1 of the second group of pixel units are turned on; in a third sub-display time period S1-3, a high level is applied to the third gate line G3, so that the switching transistors T1 of the third group of pixel units are turned on; and so on. As a result, in the first sub-display time period S1-1, the first data line D1 applies a positive polarity data signal to a pixel electrode through a control transistor T2 and a switching transistor T1 of a pixel unit P11, the second data line D2 applies a negative polarity data signal to a pixel electrode through a control transistor T2 and a switching transistor T1 of a pixel unit P12, the third data line D3 applies a positive polarity data signal to a pixel electrode through a control transistor T2 and a switching transistor T1 of a pixel unit P13, and so on. In the second sub-display time period S1-2, the first data line D1 applies a positive polarity data signal to a pixel electrode through a control transistor T2 and a switching transistor T1 of a pixel unit P41, the second data line D2 applies a negative polarity data signal to a pixel electrode through a control transistor T2 and a switching transistor T1 of a pixel unit P42, the third data line D3 applies a positive polarity data signal to a pixel electrode through a control transistor T2 and a switching transistor T1 of a pixel unit P43, and so on. In the third sub-display time period S1-3, the first data line D1 applies a positive polarity data signal to a pixel electrode through a control transistor T2 and a switching transistor T1 of a pixel unit P71, the second data line D2 applies a negative polarity data signal to a pixel electrode through a control transistor T2 and a switching transistor T1 of a pixel unit P72, the third data line D3 applies a positive polarity data signal to a pixel electrode through a control transistor T2 and a switching transistor T1 of a pixel unit P73, and so on.

In the second display time period S2, a low level is applied to the first control signal line V1 and the third control signal line V3, so that the control transistors T2 of the first row of pixel units, the fourth row of pixel units, the seventh row of pixel units, the third row of pixel units, the sixth row of pixel units, and the ninth row of pixel units are turned on. A high level is applied to the second control signal line V2, so that the control transistors T2 of the second row of pixel units, the fifth row of pixel units, and the eighth row of pixel units are turned on. A negative polarity data signal is applied to the first data line D1, a positive polarity data signal is applied to the second data line D2, a negative polarity data signal is applied to the third data line D3, and so on. In a first sub-display time period S2-1, a high level is applied to the first gate line G1, so that the switching transistors T1 of the first group of pixel units are turned on; in a second sub-display time period S2-2, a high level is applied to the second gate line G2, so that the switching transistors T1 of the second group of pixel units are turned on; in a third sub-display time period S2-3, a high level is applied to the third gate line G3, so that the switching transistors T1 of the third group of pixel units are turned on; and so on. As a result, in the first sub-display time period S2-1, the first data line D1 applies a negative polarity data signal to a pixel electrode through a control transistor T2 and a switching transistor T1 of a pixel unit P21, the second data line D2 applies a positive polarity data signal to a pixel electrode through a control transistor T2 and a switching transistor T1 of a pixel unit P22, the third data line D3 applies a negative polarity data signal to a pixel electrode through a control transistor T2 and a switching transistor T1 of a pixel unit P23, and so on. In the second sub-display time period S2-2, the first data line D1 applies a negative polarity data signal to a pixel electrode through a control transistor T2 and a switching transistor T1 of a pixel unit P51, the second data line D2 applies a positive polarity data signal to a pixel electrode through a control transistor T2 and a switching transistor T1 of a pixel unit P52, the third data line D3 applies a negative polarity data signal to a pixel electrode through a control transistor T2 and a switching transistor T1 of a pixel unit P53, and so on. In the third sub-display time period S2-3, the first data line D1 applies a negative polarity data signal to a pixel electrode through a control transistor T2 and a switching transistor T1 of a pixel unit P81, the second data line D2 applies a positive polarity data signal to a pixel electrode through a control transistor T2 and a switching transistor T1 of a pixel unit P82, the third data line D3 applies a negative polarity data signal to a pixel electrode through a control transistor T2 and a switching transistor T1 of a pixel unit P83, and so on.

In the third display time period S3, a low level is applied to the first control signal line V1 and the second control signal line V2, so that the control transistors T2 of the first row of pixel units, the second row of pixel units, the fourth row of pixel units, the fifth row of pixel units, the seventh row of pixel units, and the eighth row of pixel units are turned off. A high level is applied to the third control signal line V3, so that the control transistors T2 of the third row of pixel units, the sixth row of pixel units, and the ninth row of pixel units are turned on. A positive polarity data signal is applied to the first data line D1, a negative polarity data signal is applied to the second data line D2, a positive polarity data signal is applied to the third data line D3, and so on. In a first sub-display time period S3-1, a high level is applied to the first gate line G1, so that the switching transistors T1 of the first group of pixel units are turned on; in a second sub-display time period S3-2, a high level is applied to the second gate line G2, so that the switching transistors T1 of the second group of pixel units are turned on; in a third sub-display time period S3-3, a high level is applied to the third gate line G3, so that the switching transistors T1 of the third group of pixel units are turned on; and so on. As a result, in the first sub-display time period S3-1, the first data line D1 applies a positive polarity data signal to a pixel electrode through a control transistor T2 and a switching transistor T1 of a pixel unit P31, the second data line D2 applies a negative polarity data signal to a pixel electrode through a control transistor T2 and a switching transistor T1 of a pixel unit P32, the third data line D3 applies a positive polarity data signal to a pixel electrode through a control transistor T2 and a switching transistor T1 of a pixel unit P33, and so on. In the second sub-display time period S3-2, the first data line D1 applies a positive polarity data signal to a pixel electrode through a control transistor T2 and a switching transistor T1 of a pixel unit P61, the second data line D2 applies a negative polarity data signal to a pixel electrode through a control transistor T2 and a switching transistor T1 of a pixel unit P62, the third data line D3 applies a positive polarity data signal to a pixel electrode through a control transistor T2 and a switching transistor T1 of a pixel unit P63, and so on. In the third sub-display time period S3-3, the first data line D1 applies a positive polarity data signal to a pixel electrode through a control transistor T2 and a switching transistor T1 of a pixel unit P91, the second data line D2 applies a negative polarity data signal to a pixel electrode through a control transistor T2 and a switching transistor T1 of a pixel unit P92, the third data line D3 applies a positive polarity data signal to a pixel electrode through a control transistor T2 and a switching transistor T1 of a pixel unit P93, and so on.

Figure 7:
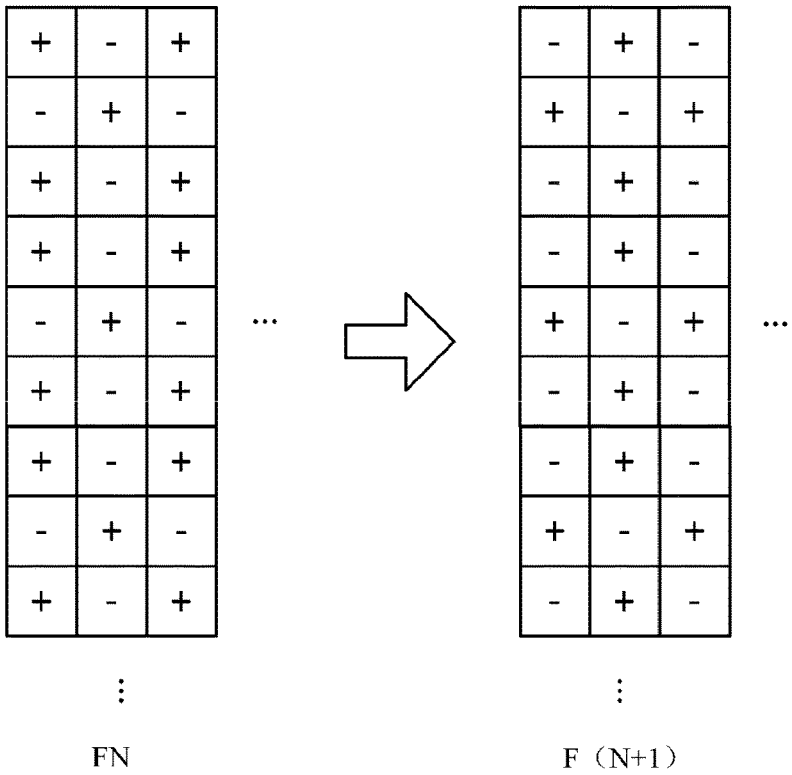
FIG. 7 schematically illustrates a pixel voltage polarity diagram for the driving method as shown in FIG. 6.

FIG. 7 schematically illustrates a pixel voltage polarity diagram for the driving method as shown in FIG. 6 when the refresh of one frame image ends. As shown in FIG. 7, in the N-th frame FN, for every four rows of pixel voltages, the polarity of the second row of pixel voltages is inverted with respect to the polarity of the first row of pixel voltages, the polarity of the third row of pixel voltages is inverted with respect to the polarity of the second row of pixel voltages, and the polarity of the fourth row of pixel voltages remains the same as the polarity of the third row of pixel voltages. For the next four rows of pixel voltages, the polarity of the first row of pixel voltages is inverted with respect to the polarity of the fourth row of pixel voltages in the former four rows of pixel voltages, and other rows of pixel voltages are similar to the former four rows. Further, as shown in FIG. 7, in the N-th frame FN, the polarities of adjacent pixel voltages in the row direction are opposite to each other. In the (N+1)-th frame F(N+1), the polarity of the pixel voltage of each pixel unit is opposite to that in the previous frame FN.

As can be seen from FIG. 7, in the driving method shown in FIG. 6, the frequency of the data signal is lower than that of the dot inversion driving method, and therefore, the power consumption of this driving method is lower than that of the dot inversion driving method.

Figure 8:
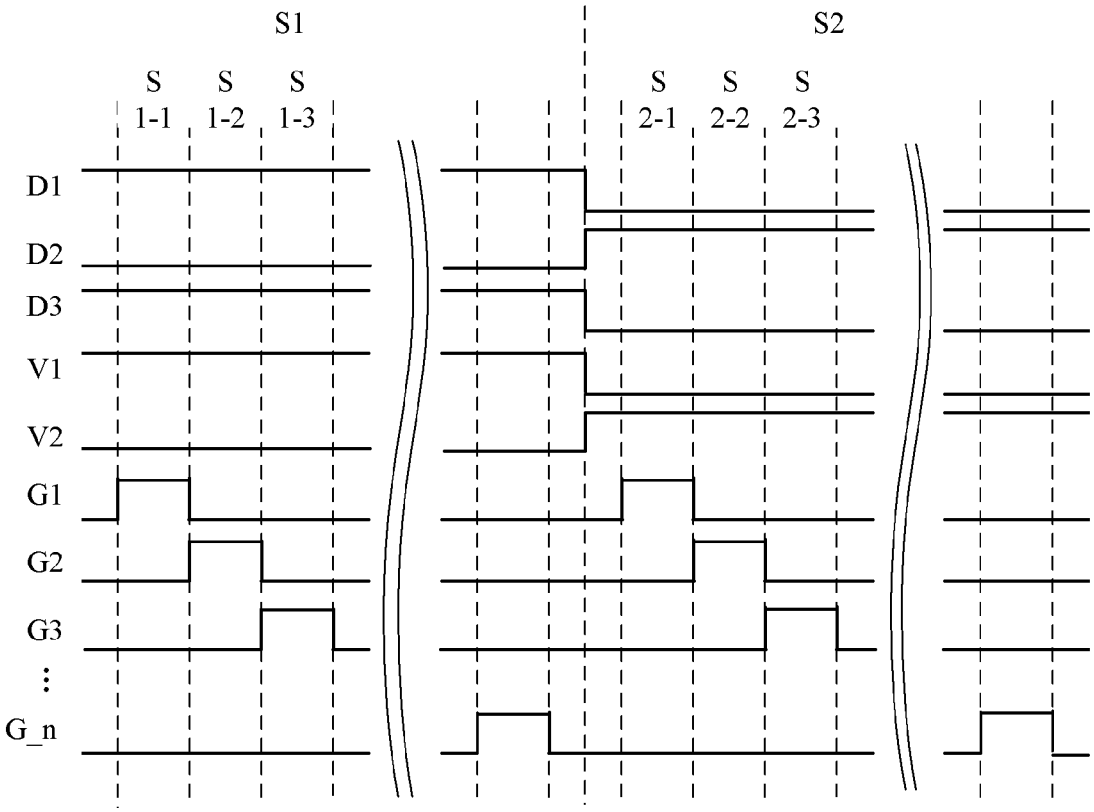
FIG. 8 schematically illustrates a timing chart of a driving method for the display substrate as shown in FIG. 3.

FIG. 8 schematically illustrates a timing chart of a driving method for the display substrate shown in FIG. 3. Hereinafter, description will be made based on an example in which the switching transistor T1 and the control transistor T2 are N-type transistors. However, as will be appreciated by those skilled in the art, this driving method is similarly applicable to P-type transistors.

As shown in FIG. 8, each frame display time is divided into two display time periods S1 and S2. A high level is applied to the two control signal lines V1 and V2 in a first display time period S1 and a second display time period S2, respectively. In each display time period S1 or S2, a high level is applied to the plurality of gate lines G1, G2, G3, . . . , G_n successively. In the second display time period S2, a data signal having an opposite polarity to that in the first display time period S1 is applied to the plurality of data lines D1, D2, D3 . . . , respectively. In each frame, the polarity of the data signal applied to each of the data lines D1, D2, D3 . . . is always opposite to the polarity of the data signal applied to a data line adjacent thereto, and the polarity of the data signal applied to each of the data lines D1, D2, D3 . . . is inverted between adjacent frames FN and F(N+1).

Taking the frame FN as an example, in the first display time period S1, a high level is applied to the first control signal line V1, so that the control transistors T2 of the first row of pixel units, the fourth row of pixel units, and the fifth row of pixel units are turned on. A low level is applied to the second control signal line V2, so that the control transistors T2 of the second row of pixel units, the third row of pixel units, and the sixth row of pixel units are turned off. A positive polarity data signal is applied to the first data line D1, a negative polarity data signal is applied to the second data line D2, a positive polarity data signal is applied to the third data line D3, and so on. In a first sub-display time period S1-1, a high level is applied to the first gate line G1, so that the switching transistors T1 of the first group of pixel units are turned on; in a second sub-display time period S1-2, a high level is applied to the second gate line G2, so that the switching transistors T1 of the second group of pixel units are turned on; in a third sub-display time period S1-3, a high level is applied to the third gate line G3, so that the switching transistors T1 of the third group of pixel units are turned on; and so on. As a result, in the first sub-display time period S1-1, the first data line D1 applies a positive polarity data signal to a pixel electrode through a control transistor T2 and a switching transistor T1 of a pixel unit P11, the second data line D2 applies a negative polarity data signal to a pixel electrode through a control transistor T2 and a switching transistor T1 of a pixel unit P12, the third data line D3 applies a positive polarity data signal to a pixel electrode through a control transistor T2 and a switching transistor T1 of a pixel unit P13, and so on. In the second sub-display time period S1-2, the first data line D1 applies a positive polarity data signal to a pixel electrode through a control transistor T2 and a switching transistor T1 of a pixel unit P41, the second data line D2 applies a negative polarity data signal to a pixel electrode through a control transistor T2 and a switching transistor T1 of a pixel unit P42, the third data line D3 applies a positive polarity data signal to a pixel electrode through a control transistor T2 and a switching transistor T1 of a pixel unit P43, and so on. In the third sub-display time period S1-3, the first data line D1 applies a positive polarity data signal to a pixel electrode through a control transistor T2 and a switching transistor T1 of a pixel unit P51, the second data line D2 applies a negative polarity data signal to a pixel electrode through a control transistor T2 and a switching transistor T1 of a pixel unit P52, the third data line D3 applies a positive polarity data signal to a pixel electrode through a control transistor T2 and a switching transistor T1 of a pixel unit P53, and so on.

In the second display time period S2, a low level is applied to the first control signal line V1, so that the control transistors T2 of the first row of pixel units, the fourth row of pixel units, and the fifth row of pixel units are turned off. A high level is applied to the second control signal line V2, so that the control transistors T2 of the second row of pixel units, the third row of pixel units, and the sixth row of pixel units are turned on. A negative polarity data signal is applied to the first data line D1, a positive polarity data signal is applied to the second data line D2, a negative polarity data signal is applied to the third data line D3, and so on. In a first sub-display time period S2-1, a high level is applied to the first gate line G1, so that the switching transistors T1 of the first group of pixel units are turned on; in a second sub-display time period S2-2, a high level is applied to the second gate line G2, so that the switching transistors T1 of the second group of pixel units are turned on; in a third sub-display time period S2-3, a high level is applied to the third gate line G3, so that the switching transistors T1 of the third group of pixel units are turned on; and so on. As a result, in the first sub-display time period S2-1, the first data line D1 applies a negative polarity data signal to a pixel electrode through a control transistor T2 and a switching transistor T1 of a pixel unit P21, the second data line D2 applies a positive polarity data signal to a pixel electrode through a control transistor T2 and a switching transistor T1 of a pixel unit P22, the third data line D3 applies a negative polarity data signal to a pixel electrode through a control transistor T2 and a switching transistor T1 of a pixel unit P23, and so on. In the second sub-display time period S2-2, the first data line D1 applies a negative polarity data signal to a pixel electrode through a control transistor T2 and a switching transistor T1 of a pixel unit P31, the second data line D2 applies a positive polarity data signal to a pixel electrode through a control transistor T2 and a switching transistor T1 of a pixel unit P32, the third data line D3 applies a negative polarity data signal to a pixel electrode through a control transistor T2 and a switching transistor T1 of a pixel unit P33, and so on. In the third sub-display time period S2-3, the first data line D1 applies a negative polarity data signal to a pixel electrode through a control transistor T2 and a switching transistor T1 of a pixel unit P61, the second data line D2 applies a positive polarity data signal to a pixel electrode through a control transistor T2 and a switching transistor T1 of a pixel unit P62, the third data line D3 applies a negative polarity data signal to a pixel electrode through a control transistor T2 and a switching transistor T1 of a pixel unit P63, and so on.

Figure 9:
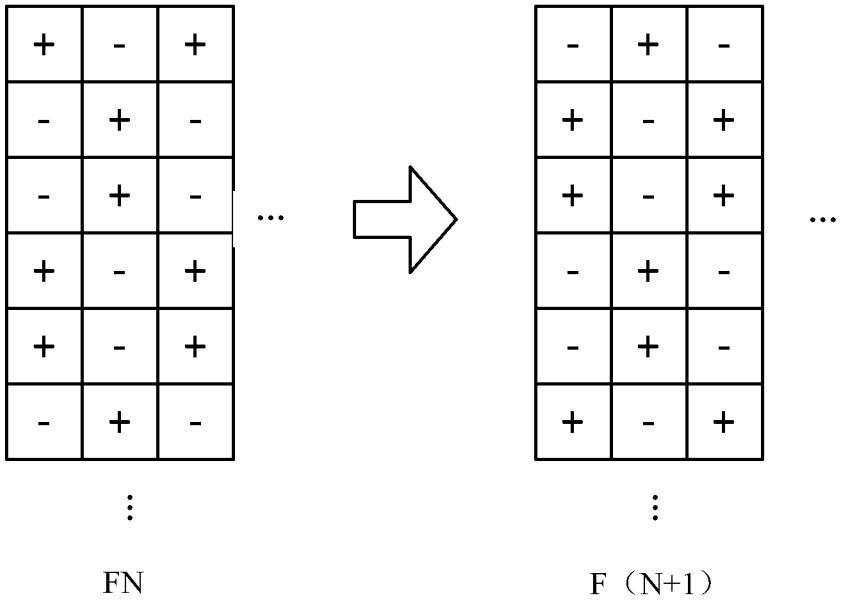
FIG. 9 schematically illustrates a pixel voltage polarity diagram for the driving method as shown in FIG. 8.

FIG. 9 schematically illustrates a pixel voltage polarity diagram for the driving method as shown in FIG. 8 when the refresh of one frame image ends. As shown in FIG. 9, in the N-th frame FN, the polarity of the pixel voltage is inverted once every two rows in the column direction, and the polarities of adjacent pixel voltages in the row direction are opposite to each other. Further, in the (N+1)-th frame F(N+1), the polarity of the pixel voltage of each pixel unit is opposite to that in the previous frame FN.

As can be seen from FIG. 9, the driving method shown in FIG. 8 employs column two-dot inversion, that is, positive and negative polarity inversion is performed for each column by taking two pixel units as a unit, and performed for two adjacent columns of pixel units by taking a column as a unit. By such processing, the phase difference generated by flicker waveforms of several adjacent pixel units makes the flickering effect of the column two-dot inversion driving method close to the flickering effect of the dot inversion driving method. A data driving IC inverts the data signal voltage by taking two addressing times as a unit. The frequency of the data signal is between the dot inversion and the column inversion, thus the power consumption of the column two-dot inversion driving method is higher than that of the column inversion driving method, but is lower than that of the dot inversion driving method.

Figure 10:
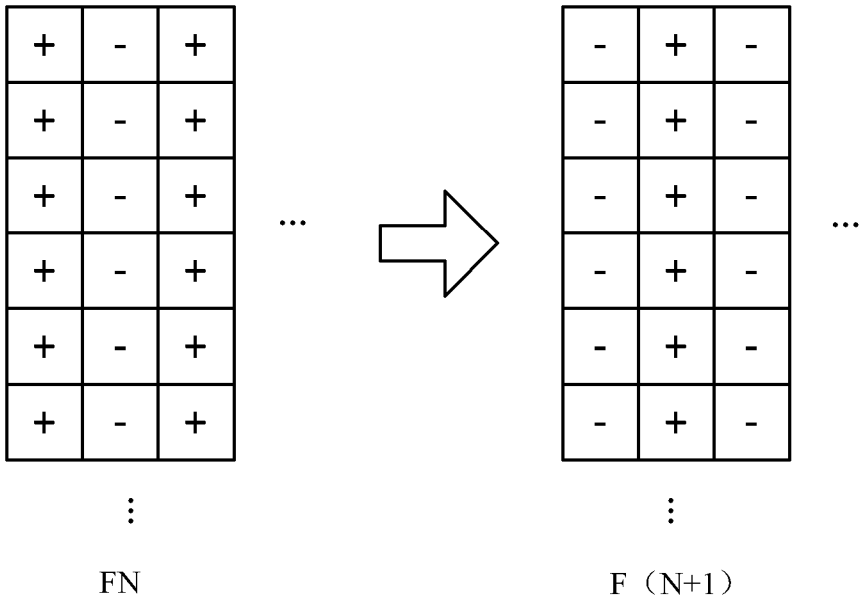
FIG. 10 schematically illustrates a pixel voltage polarity diagram for a column inversion driving method.

As known to those skilled in the art, the "column inversion" driving method means that positive and negative polarity inversion is performed for corresponding pixel units on adjacent data lines by taking a column as a unit, and in the next frame image, the polarities of the pixel voltages of all the pixel units are inverted simultaneously, as shown in FIG. 10. In the column inversion driving method, since the flicker waveforms of two adjacent columns have a phase difference, flickers are suppressed to some extent. However, since there is no phase difference between the flicker waveforms of all the sub-pixels in each column, line flickers in the column direction easily occur. Since column inversion belongs to low frequency inversion, its power consumption is lowest.

It is to be noted that although the concept of the present disclosure is illustrated in the foregoing embodiments based on examples in which each group of pixel units includes consecutive pixel unit rows, the present disclosure is not so limited. In other embodiments, each group of pixel units may include n inconsecutive pixel unit rows. For example, the first group of pixel units may include odd-numbered rows of pixel units, the second group of pixel units may include even-numbered rows of pixel units, and so on.

The present disclosure can be widely applied to various TFT LCDs as well as other devices and apparatuses having display function which are fabricated using a-Si, oxides, LTPS, HTPS, and the like. In particular, when n is equal to 2, the embodiments of the present disclosure are particularly applicable to an LCD display panel fabricated based on the LTPS process, since in these embodiments, the active level time of the first control signal line V1 and the second control signal line V2 are both a half frame, so that the switching transistor of each pixel unit has a longer bias time, and the turn-on current of an LTPS TFT is less sensitive to the bias voltage, so attenuation is less likely to occur.

Those skilled in the art will recognize that the present disclosure is in no way limited to the exemplary embodiments described above. On the contrary, many modifications and variations are possible within the scope of the appended claims. For example, other components may be added to or removed from the described devices. Other embodiments may be within the scope of the present disclosure. In addition, in the claims, the word "comprising" does not exclude other elements or steps. The mere fact that certain measures are recited in mutually different dependent claims does not indicate that a combination of these measures cannot be used to advantage.

The invention claimed is:

1. A display substrate comprising:

a plurality of pixel units arranged in a matrix, wherein the plurality of pixel units are divided into multiple groups of pixel units along a column direction of the pixel units, wherein each group of pixel units of the multiple groups comprises n rows of pixel units;

a plurality of gate lines extending along a row direction of the pixel units, wherein the plurality of gate lines are in one-to-one correspondence with the multiple groups of pixel units;

a plurality of data lines extending along the column direction of the pixel units, wherein the plurality of data lines are in one-to-one correspondence with pixel unit columns in the matrix; and n control signal lines extending along the row direction of the pixel units, wherein the n control signal lines are in one-to-one correspondence with n rows of pixel units in each group of pixel units, wherein each respective pixel unit of the plurality of pixel units comprises a switching circuit, connected to a corresponding gate line, a control circuit associated with the respective pixel unit, and a corresponding pixel electrode, wherein the control circuits configured to transmit a corresponding data signal on a corresponding data line to the switching circuit of respective pixel unit under control of a corresponding control signal line, and wherein n is an integer that is not less than 2.

2. The display substrate according to claim 1, wherein the switching circuit comprises a switching transistor, wherein a control terminal of the switching transistor is connected to a corresponding gate line, wherein a first terminal of the switching transistor is connected to the control circuit of the respective pixel unit, and wherein a second terminal of the switching transistor is connected to the corresponding pixel electrode.

3. The display substrate according to claim 2, wherein the control circuit comprises a control transistor, wherein a control terminal of the control transistor is connected to a corresponding control signal line, wherein a first terminal of the control transistor is connected to a corresponding data line, and wherein a second terminal of the control transistor is connected to the first terminal of the switching transistor of the respective pixel unit.

4. The display substrate according to claim 1, wherein the n control signal lines are in one-to-one correspondence with n rows of pixel units in each group of pixel units in forward order.

5. The display substrate according to claim 1, wherein the n control signal lines are in one-to-one correspondence with n rows of pixels units in odd-numbered groups of pixel units in forward order, and wherein the n control signal lines are in one-to-one correspondence with n rows of pixel units in even-numbered groups of pixel units in reverse order.

6. The display substrate according to claim 5, wherein along the column direction of the pixel units, a first row of pixels units in each even-numbered group of pixel units of the even-numbered groups and a last row of pixel units in a previous group of pixel units are connected to an n-th control signal line through a same connection line.

7. The display substrate according to claim 1 wherein n is equal to 2.

8. The display substrate according to claim 1, wherein the plurality of gate lines are connected to a gate driving integrated circuit.

9. The display substrate according to claim 1, wherein the plurality of gate lines are connected to a Gate Driver on Array (GOA) circuit.

10. A display panel comprising the display substrate according to claim 1.

11. The display panel according to claim 10, wherein the display panel comprises a liquid crystal display panel.

12. The display panel according to claim 11, wherein the liquid crystal display panel is fabricated based on a low-temperature polysilicon process.

13. The display panel according to claim 10, wherein the switching circuit comprises a switching transistor, wherein a control terminal of the switching transistor is connected to a corresponding gate line, wherein a first terminal of the switching transistor is connected to a control circuit of the respective pixel unit where the switching transistor resides, and wherein a second terminal of the switching transistor is connected to the corresponding pixel electrode.

14. The display panel according to claim 13, wherein the control circuit comprises a control transistor, wherein a control terminal of the control transistor is connected to a corresponding control signal line, wherein a first terminal of the control transistor is connected to a corresponding data line, and wherein a second terminal of the control transistor is connected to a first terminal of the switching transistor of the corresponding pixel unit where the control transistor resides.

15. The display panel according to claim 10, wherein the n control signal lines are in one-to-one correspondence with n rows of pixel units in each group of pixel units in forward order.

16. The display panel according to claim 10, wherein the n control signal lines are in one-to-one correspondence with n rows of pixel units in odd-numbered groups of pixel units in forward order, and wherein the n control signal lines are in one-to-one correspondence with n rows of pixel units in even-numbered groups of pixel units in reverse order.

17. The display panel according to claim 16, wherein along the column direction of the pixel units, a first row of pixels units in each even-numbered group of pixel units of the even-numbered groups and a last row of pixel units in a previous group of pixel units are connected to an n-th control signal line through a same connection line.

18. The display panel according to claim 10, wherein n is equal to 2.

19. The display panel according to claim 10, wherein the plurality of gate lines are connected to a gate driving integrated circuit.

20. A method for driving a display substrate according to claim 1, comprising:

dividing each frame display time into n display time periods, applying an active level to the n control signal lines in the n display time periods, respectively, and in each display time period of the display time periods, applying the active level to the plurality of gate lines successively, and applying to the plurality of data lines a data signal having an opposite polarity to that in a previous display time period, respectively, wherein a polarity of a first data signal applied to each data line is opposite to that of a second data signal applied to an adjacent data line, and wherein the polarity of the first data signal applied to each data line is inverted between adjacent frames.

* * * * *